US005884127A

United States Patent [19]

Kim et al.

[11] Patent Number: 5,884,127

[45] Date of Patent: Mar. 16, 1999

[54] SQUEEZE ROLLER ASSEMBLY OF WET TYPE DEVELOPER FOR AN ELECTROPHOTOGRAPHIC PRINTER

[75] Inventors: Wan-ha Kim; Kee-son Chang; Jin-geun Kwak, all of Suwon, Rep. of Korea

[73] Assignee: Samsung Electronics Co., Ltd., Kyungki-Do, Rep. of Korea

[21] Appl. No.: 55,698

[22] Filed: Apr. 7, 1998

[30] Foreign Application Priority Data

Aug. 25, 1997 [KR] Rep. of Korea ..... 1997 40712

[51] Int. Cl.[6] ..... G03G 15/01

[52] U.S. Cl. ..... 399/249

[58] Field of Search ..... 399/249, 348, 399/357, 245; 15/256.5, 256.51

[56] References Cited

U.S. PATENT DOCUMENTS 4,248,522 2/1981 Davis ..... 399/249

*Primary Examiner*—S. Lee

*Attorney, Agent, or Firm*—Sughrue, Mion, Zinn, Macpeak & Seas, PLLC

[57] ABSTRACT

In a squeeze roller assembly of a wet type developer of an electrophotographic printer, a shaft is rotatably installed in a frame. A first roller is fixed on the shaft for filming solid toner from a developing liquid onto a photosensitive belt. Second rollers are rotatably installed on the same shaft at both sides of the first roller. The first roller, attached to the central portion of the imaging surface of a photosensitive belt, rotates in the same direction as that of the conveying direction of the photosensitive belt. The second roller rotates in a direction opposite to the direction of the photosensitive belt by an inverse rotator. Therefore, it is possible to reduce the required installation space by having the first and second rollers share a common shaft as a rotating axis.

3 Claims, 3 Drawing Sheets

SQUEEZE ROLLER ASSEMBLY OF WET TYPE DEVELOPER FOR AN ELECTROPHOTOGRAPHIC PRINTER

BACKGROUND OF THE INVENTION

1. Field of the Invention

The present invention relates to a squeeze roller assembly of a wet type developer for an electrophotographic printer and, more particularly, to a squeeze roller assembly for removing a liquid carrier from a developing liquid which is supplied to the photosensitive medium of an electrophotographic printer.

2. Description of the Related Art

In general, a wet type developer is used for developing a desired latent image on an imaging surface of a photosensitive medium such as a photosensitive belt. A squeeze roller assembly creates a film of solid toner, which is contained in the developing liquid, on to the imaging surface by compressing the imaging surface of the photosensitive belt and squeezing away the liquid carrier.

As shown in FIGS. 1 and 2, a conventional squeeze roller assembly 210 comprises a first squeeze roller 211 and a second squeeze roller 212. The first squeeze roller 211 is installed to contact an imaging surface 111 of a photosensitive belt 11 and to be passively driven by the photosensitive belt 11 in the same direction as the movement of the belt. The second squeeze roller 212 is installed to contact both edges 111*b* of the photosensitive belt 11 and to be driven by a predetermined driving source (not shown) in an opposite direction in which the photosensitive belt 11 proceeds. The developing liquid for forming an image is supplied to the central portion 111*a* of the imaging surface 111. Reference numeral A denotes a contact line on which the first squeeze roller 211 and the photosensitive belt 11 are contacted. Reference numeral 213 denotes a developing roller for delivering the developing liquid $I_1$ supplied through an injection nozzle 10 into the imaging surface 111 of the photosensitive belt 11. Reference numeral 214 denotes a cleaning roller for cleaning the photosensitive roller 213. The developing liquid $I_1$ contains a liquid carrier $I_2$.

The first squeeze roller 211 compresses the imaging surface 111, rotating in the same direction as that of the conveying direction of the photosensitive belt 11, to film the solid toner contained in the developing liquid $I_1$ onto the imaging surface 111 and to remove the liquid carrier $I_2$ contained in the developing liquid $I_1$ from the imaging surface 111. The carrier $I_2$, which is removed as mentioned above, runs down along the downstream side of the first squeeze roller 211 and drips to the inside of the main body 20. However, the remaining liquid carrier $I_3$, which is pushed outward toward opposite ends of the first squeeze roller 211, goes over both ends 211*a* (FIG. 2) of the first squeeze roller 211, and resides in an area W of both edges 111*b* of the photosensitive belt 11. This is generally called a wrap-around phenomenon.

The wrap-around phenomenon is a type of capillary tube phenomenon, which occurs because the first squeeze roller 211 which contacts the first photosensitive belt 11 rotates in the same direction as that of the proceeding direction of the photosensitive belt 11. To remove the carrier $I_3$ residing in the area W of both edges 111*b* of the photosensitive belt 11, the second squeeze roller 212 is rotated in the direction opposite to the conveying direction of the photosensitive belt 11 and first squeeze roller 211.

In the conventional squeeze roller assembly 210 having the above structure, the structure is complicated and the main body 20 of the developer must be large in order to secure the installation space for the squeeze rollers 211 and 212 since the first squeeze roller 211 and the second squeeze roller 212 are installed on separate rotating axes.

SUMMARY OF THE INVENTION

To solve the above problems, an objective of the present invention is to provide a squeeze roller assembly of a wet type developer having an improved structure to effectively remove a carrier within a narrow space by installing rollers having the functions of first and second squeeze rollers on a rotating axis.

Accordingly, to achieve the above object, the present invention provides a squeeze roller assembly of a wet type developer of an electrophotographic printer for removing a liquid carrier in a developing liquid by compressing an imaging surface of a photosensitive belt to which the developing liquid is applied, comprising a shaft rotatably installed in a frame, a first roller fixed to the shaft so as to compress the central portion of the imaging surface, a second roller rotatably installed on the shaft at both sides of the first roller so as to compress both edges of the photosensitive belt, and an inverse rotating means for rotating the second roller in a direction opposite to that of the first roller.

The inverse rotating means comprises a first gear provided in the shaft, a second gear provided in the second roller, and junction gears for connecting the first and second gears so as to rotate in opposite directions to each other.

BRIEF DESCRIPTION OF THE DRAWINGS

The above objective and advantage of the present invention will become more apparent by describing in detail a preferred embodiment thereof with reference to the attached drawings in which.

DESCRIPTION OF THE PREFERRED EMBODIMENT(S)

Figure 1:
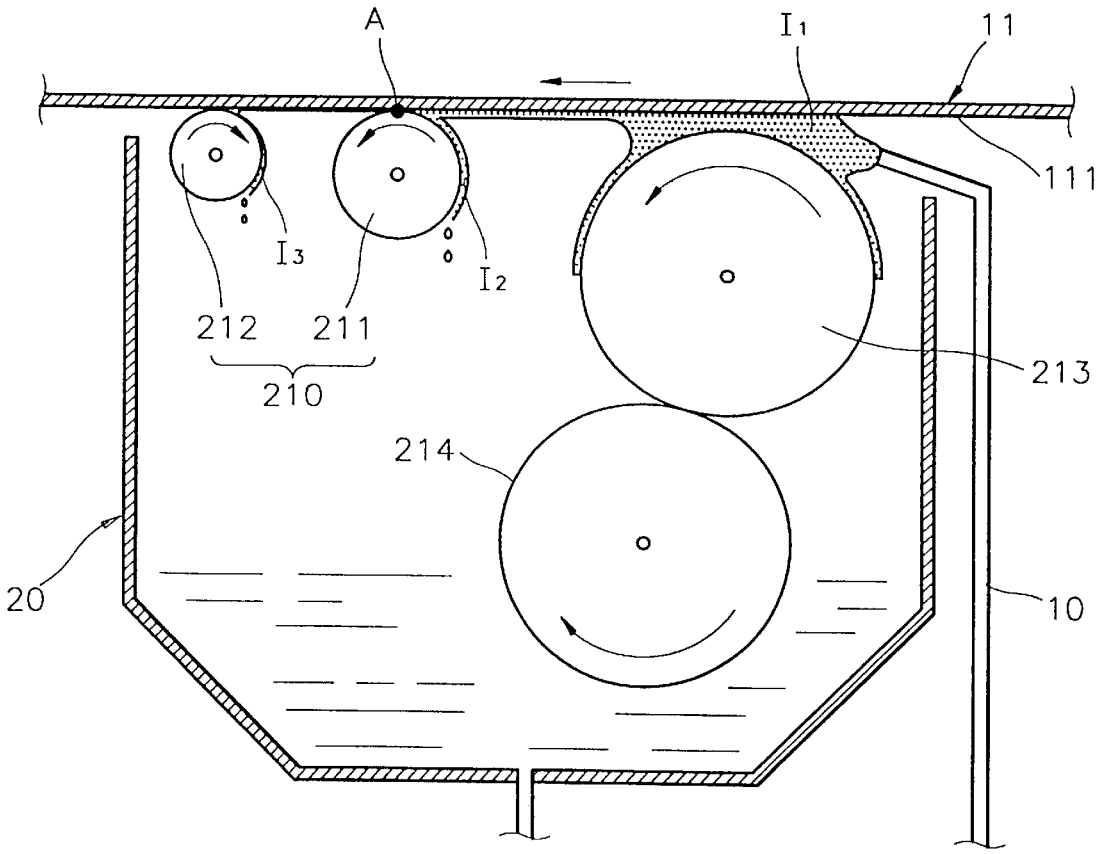
FIG. 1 (PRIOR ART)
FIG. 1 schematically shows a developer having a conventional squeeze roller.
Figure 2:
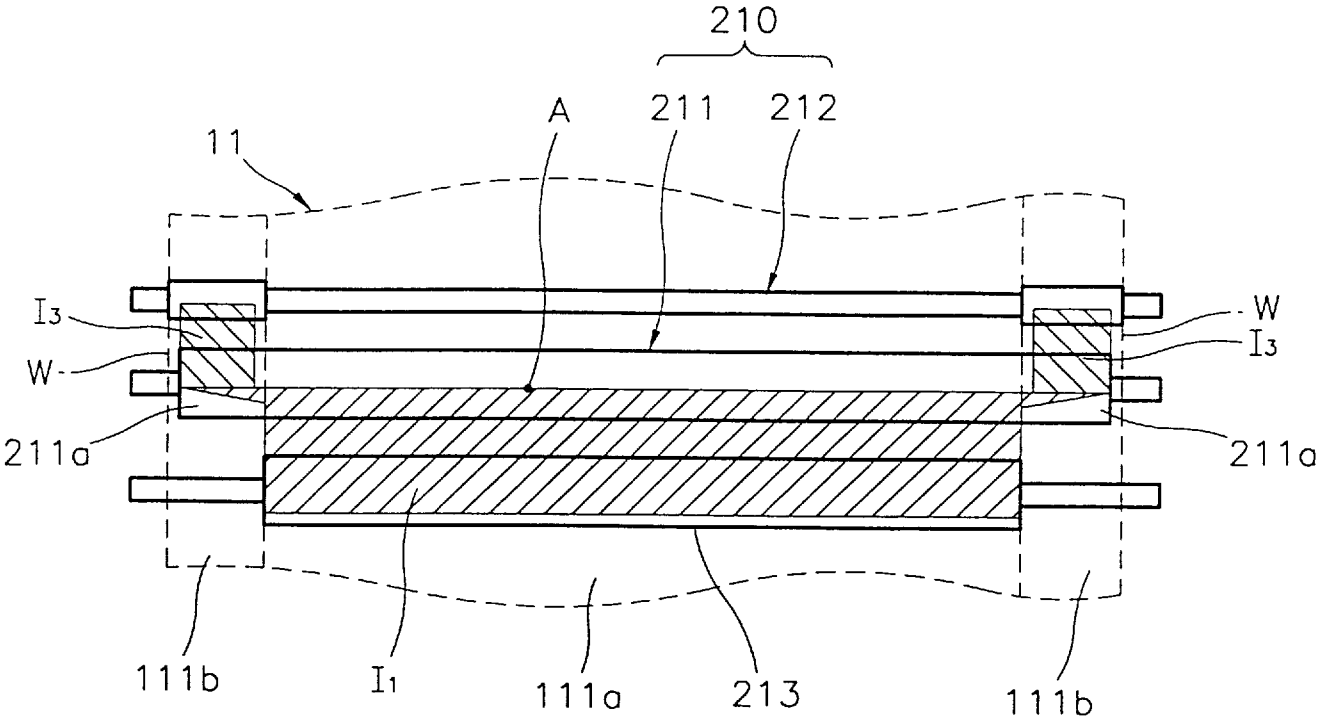
FIG. 2 (PRIOR ART)
FIG. 2 describes the function of the squeeze roller assembly shown in FIG. 1.
Figure 3:
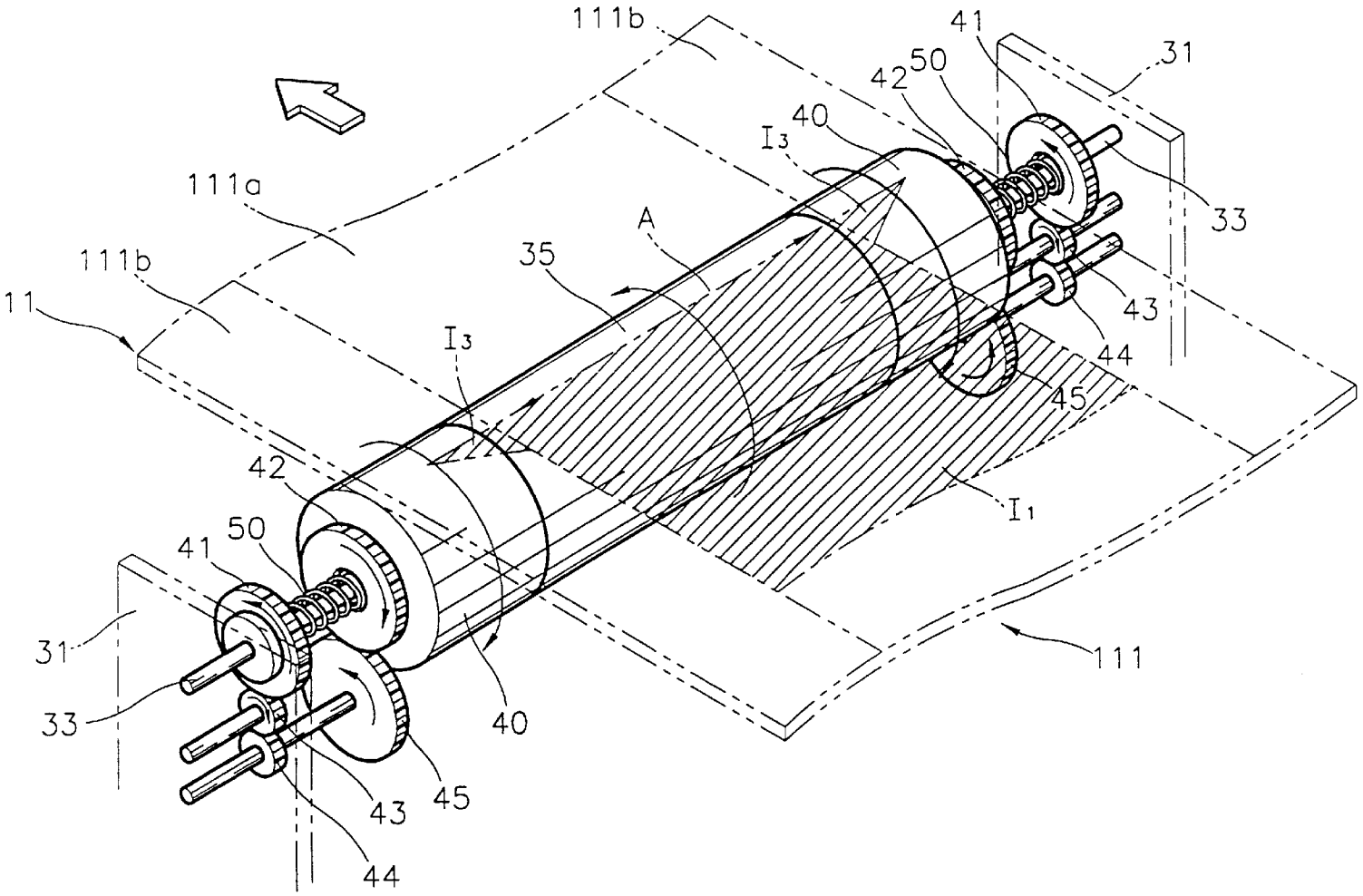
FIG. 3 is a perspective view showing a squeeze roller assembly according to the present invention.

Referring to FIG. 3, showing a squeeze roller according to the present invention, a shaft 33 is rotatably installed in a frame 31. A first roller 35 is fixed in the shaft 33. A second roller 40 is rotatably installed on the shaft 33 at both outer sides of the first roller 35. The first roller 35 corresponding to the central portion 111*a* of the imaging surface 111 of the photosensitive belt 11 rotates in the same direction as the conveying direction of the photosensitive belt 11. The second roller 40 rotates in the direction opposite to the conveying direction of the photosensitive belt 11 by an inverse rotating means.

The inverse rotating means includes a first gear 41 rotating with the shaft 33, a second gear 42 provided on the second roller 40, and junction gears 43, 44, and 45 engaged with the first and second gears 41 and 42 so as to rotate in opposite directions respectively. Specifically, the first roller 35 rotates in the same direction as that of the shaft 33. The second roller 40 rotates in the direction opposite to that of the first roller 35, driven by the first and second gears 41 and 42 and the junction gears 43, 44, and 45. An elastic member such as a compression spring 50 is installed between the first gear 41 and the second gear 42 to bias the second roller 40 to the first roller 35.

In the operation of the squeeze roller assembly according to a preferred embodiment, the first roller 35 is driven by the photosensitive belt 11 in the same direction to compress the central portion 111*a* of the imaging surface 111, so that it squeezes the carrier contained in the developing liquid $I_1$ and creates a film of solid toner from the developing liquid $I_1$ onto the central portion 111*a*. The squeezed carrier runs down along the downstream side of the first roller 35. The remaining carrier $I_3$ is pushed outward toward opposite ends of the first roller 35 along the contact line A, i.e., toward the second roller 40. The second roller 40 rotates in the direction opposite to that of the first roller 35, i.e., in the direction opposite to the direction of the photosensitive belt 11 by the inverse rotating means, e.g., the first gear 41, the junction gears 43, 44, and 45, and the second gear 42. Accordingly, the carrier $I_3$ is intercepted by the second roller 40, and does not go over the second roller 40 in the direction of the photosensitive belt 11, so that it is removed.

As mentioned above, in the squeeze roller assembly of the wet type developer according to the present invention, it is not necessary to arrange a plurality of squeeze rollers on separate rotating axes as in the conventional technology since the carrier in the developing liquid is effectively removed by using the first and second rollers sharing a common shaft as a rotating axis. Therefore, it is possible to simplify the structure of the developer and reduce the installation space of the developer.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. A squeeze roller assembly of a wet type developer of an electrophotographic printer for removing a liquid carrier of a developing liquid by compressing an imaging surface of a photosensitive belt to which the developing liquid is applied, comprising:

a shaft rotatably installed in a frame;

a first roller fixed to said shaft so as to compress the central portion of the imaging surface;

a pair of second rollers rotatably installed on said shaft, located at both outer sides of said first roller so that said first roller is positioned between said pair of second rollers, for compressing both edges of the photosensitive belt; and an inverse rotating means for rotating said pair of second rollers in a direction opposite to that of said first roller.

2. The squeeze roller assembly of claim 1, wherein the inverse rotating means comprises:

a first gear provided on said shaft;

a second gear provided on each of said pair of second rollers; and junction gears for connecting said first and second gears so that said first and second gears rotate in opposite directions with respect to each other.

3. The squeeze roller assembly of claim 2, further comprising an elastic member for biasing each of said pair of second rollers toward the outer side of said first roller.

* * * * *